United States Patent [19]

Harvath

[11] Patent Number: 5,003,448

[45] Date of Patent: Mar. 26, 1991

[54] LIGHT-WEIGHT LENTICULAR LIGHTING PANEL

[75] Inventor: Leo J. Harvath, St. Louis, Mo.

[73] Assignee: K-S-H, Inc., St. Louis, Mo.

[21] Appl. No.: 476,159

[22] Filed: Feb. 7, 1990

[51] Int. Cl.[5] ..... F21V 5/02

[52] U.S. Cl. ..... 362/330; 362/339

[58] Field of Search ..... 362/309, 330, 333, 339, 362/337

[56] References Cited

U.S. PATENT DOCUMENTS

| | | | |
|---|---|---|---|
| 2,474,317 | 6/1949 | McPhail | 362/339 |
| 3,267,278 | 8/1966 | Doolittle | 362/339 X |
| 3,578,967 | 5/1971 | Stahlhut et al. | 362/333 |
| 3,794,829 | 2/1974 | Taltavull | 362/330 |

OTHER PUBLICATIONS

K-S-H Brochure KI-1617, "Are You Getting What You Specify?", 1985.

*Primary Examiner*—Stephen F. Husar
*Assistant Examiner*—Peggy Neils
*Attorney, Agent, or Firm*—Polster, Polster and Lucchesi

[57] ABSTRACT

A lighting panel has a planar upper face and a lower face having a system of aspherical female lenticules arranged in an overlapping offset pattern to form a network of diamond-shaped domed cells. The panel provides adequate light control and may be made thinner than a panel having female conical prisms. The panel also is substantially lighter weight than a panel of equivalent thickness having conical prisms, over a wide range of thicknesses. The pattern allows panels having a wide range of thicknesses to be made from the same tooling.

13 Claims, 2 Drawing Sheets

LIGHT-WEIGHT LENTICULAR LIGHTING PANEL

BACKGROUND OF THE INVENTION

This invention relates to lighting panels, and in to a light-weight plastic lighting panel used for the of light from a light source.

Lighting panels are widely used in overhead fluorescent lighting fixtures, and may be used with other light sources. Their primary purpose is to reduce direct glare by controlling the angle at which light emerges from the panel They also serve to obscure the lamps in the fixture, thereby spreading the concentrations of light and also producing a more aesthetically pleasing appearance.

Lenticular lighting panels include small refractive lenses, or lenticules, substantially covering the lower face of the panel. These panels generally require the upper face of the panel to be non-planar, and the weight of the panel to be substantial. They are therefore quite expensive to produce Examples of such panels are Lewin, U.S. Pat. Nos. 3,763,369 and 4,703,405.

Prismatic lighting panels include a planar upper face and a lower face covered with prismatic elements. Because only one face is patterned, problems of registry between patterns on the upper and lower faces of the panel are eliminated. The panel can therefore be made inexpensively in a wide variety of thicknesses by a continuous extrusion process in which soft, extruded thermoplastic material passes between a smooth roll and an embossed roll. The overall thickness of the panel may be adjusted simply by adjusting the spacing between the rolls. The continuous extrusion method reduces the cost of production of prismatic panels to the point that the cost of the panels is determined almost entirely by the cost of the thermoplastic material.

The theory of prismatic lighting panels is well known and is discussed, for example, in McPhail, U.S. Pat. No. 2,474,317. Light rays entering the top of the panel are either refracted downward through the lower surface of the panel at useful angles to the vertical (i.e., the normal of the panel), or are reflected internally by the prismatic elements upward through the upper surface of the panel. If the prismatic elements have straight sides which make the proper angle with the normal of the panel, virtually all of the light which would otherwise emerge at high angles relative to the normal of the panel is internally reflected by the prisms and high angle "direct" glare is thereby greatly reduced or eliminated.

A particularly popular prismatic lighting panel has, on its lower surface, female conical prisms, having an apex angle of about 116°. The apexes of the conical prisms are aligned along 45° diagonals to the edges of the panel and spaced three-sixteenths of an inch (0.50±0.05 centimeters) on centers. The intersections of the cones lie along lattice lines running at angles of 45° to the edges of the panel. An example of such a lighting panel is one sold by K-S-H, Inc., under the trademark KSH-12. This pattern has become a standard in the lighting panel industry.

In recent years there has been an increasing demand for inexpensive prismatic lighting panels. Because the plastic material of which the panels are made represents the major cost of prismatic lighting panels, prismatic panels have been made ever thinner, until presently they have reached the limit permitted by their geometry.

To reduce the weight further, the female conical prisms have been "hogged out" by rounding the straight edges of the conical prisms to make them somewhat concave in cross-section. The apex of the prism in "hogged out" panels has also sometimes been truncated to permit the panel to be made still thinner. Such panels give the appearance of a KSH-12 panel but are less effective optically. They are generally known in the industry by the designation "pattern-12." Such panels provide less sharply defined cut-off angles and therefore are not as effective in controlling direct glare as are panels such as the KSH-12 panels, but they do provide adequate control for many purposes. As panels have been made thinner, they also have become less effective in hiding or spreading lamp images when the fixture is viewed from below. Furthermore, the changes in prism geometry which have permitted ultralight panels to be formed in thicknesses of less than 0.100 inches (typically 0.085 to 0.090 inches), have actually increased the weight of the panel when the panel is made thicker. Therefore, multiple tooling is required. A first embossing roll is used for thicknesses under about 0.090"-0.100", and a second embossing roll is used for thicker panels, to maintain the weight as low as possible for a given thickness.

The weight of prismatic pattern-12 panels has sometimes also been reduced by physically stretching the panel in the lengthwise direction (that is, in the direction of the axes of the fluorescent tubes in a rectangular lighting fixture) after it has been embossed but before the plastic has completely cooled. Such stretching, however, creates stresses in the plastic and distorts the lattice pattern of intersecting prismatic cells.

SUMMARY OF THE INVENTION

One object of this invention is to provide a lighting panel which may be formed even thinner and lighter than previous pattern-12 panels.

Another object is to provide such a lighting panel which closely mimics the appearance of a pattern-12 panel.

Another object is to provide such a lighting panel which can be extruded in a wide range of thicknesses, using the same embossing roll and using less material in all thicknesses than a pattern-12 panel of the same thickness.

Another object is to provide such a lighting panel which provides light control at least comparable with that of a pattern-12 panel.

Another object is to provide such a lighting panel which closely mimics the appearance of a pattern-12 panel.

Another object is to provide such a lighting panel which effectively hides lamp images when viewed from below.

Other objects of this invention will be apparent to those skilled in the art in light of the following description and accompanying drawings.

In accordance with this invention, generally stated, there is provided a lenticular lighting panel having a planar upper face and a lenticular lower face, the lower face defining a plurality of aspherical female lenticules arranged in an overlapping pattern. The intersections of adjacent lenticules form the sides of domed diamond-shaped cells which lie along lattice lines. The sides are preferably about 13/64±1/64 inch long. The intersections of the lattice lines are the lowest (thickest) points on the panel, and the centers of the domes are the highest (thinnest). The vertical distance from the plane defined by the intersections of the lattice lines to the plane formed by the centers of the lenticules is preferably about 0.075±0.005 inch. The overall thickness of the panel may be as little as 0.084 inch.

Preferably, the lenticules are circular in both lengthwise and crosswise cross-section of the panel. The radius of curvature in lengthwise cross-section is about 0.203±0.005 inches, and the radius of curvature in the crosswise direction is about 0.156±0.005 inches. Therefore, the diamond shaped cells are about 5/16 inches long across one of their diagonals and about 17/64 inches long in the other diagonal. Preferably, the long diagonal of the cell extends lengthwise of a rectangular lighting panel.

Because the lenticule is ellipsoidal instead of conical or hogged out, the thickness of the panel may be greatly reduced. Conical and "hogged out" prisms are typically 0.086" in depth to accomplish acceptable light distribution. In comparison, the lenticular cell of the panel of the present invention need only be 0.070" in depth. Thus, the panel can have the same base depth as a pattern-12 prismatic panel, but have an overall depth less than that of a pattern-12 prismatic panel. Furthermore, because the lenticule is ellipsoidal, the panel is lighter in weight at all thicknesses. The use of the ellipsoidal lenticule does not greatly change the brightness or the cutoff angle from those obtained with a pattern-12 panel.

The panel is made from extruded thermoplastic which is molded by a roll having a mold of the panel pattern thereon. The stretch of the diamond shaped cells is not produced by mechanical action, but is rather molded into the panel. The same mold is used to form panels of varying thicknesses. Thus, the process need not be shut down to alter panel depths. To change panel depths with the mold of the present invention requires only moving the embossing roll closer to or farther from the smooth roll forming the upper side of the panel.

DESCRIPTION OF THE PREFERRED EMBODIMENT

Figure 1:
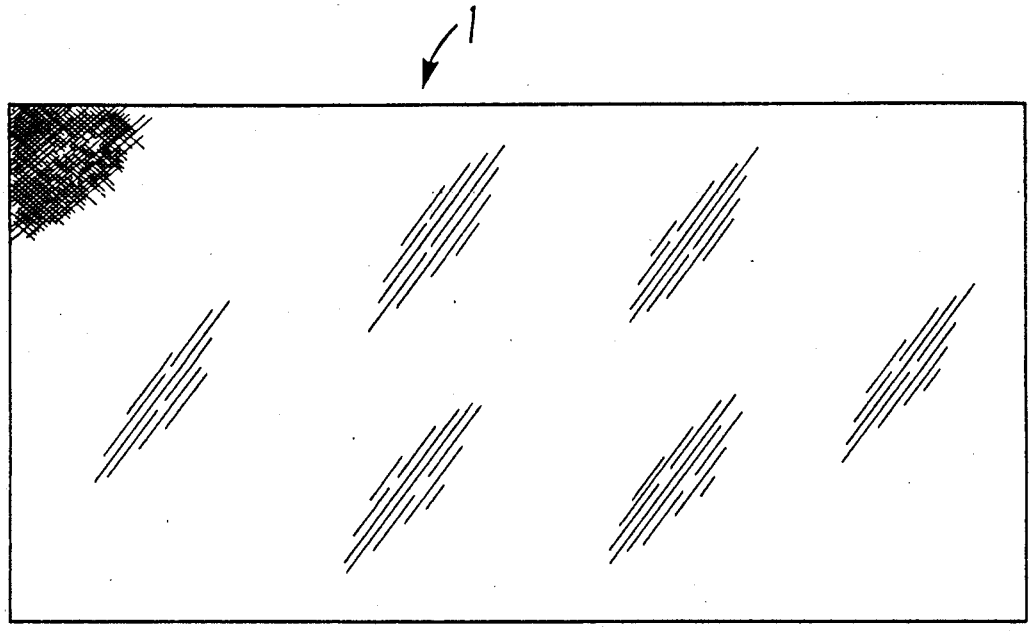
FIG. 1 is a bottom plan view of a lenticular lighting panel of the present invention.
Figure 2:
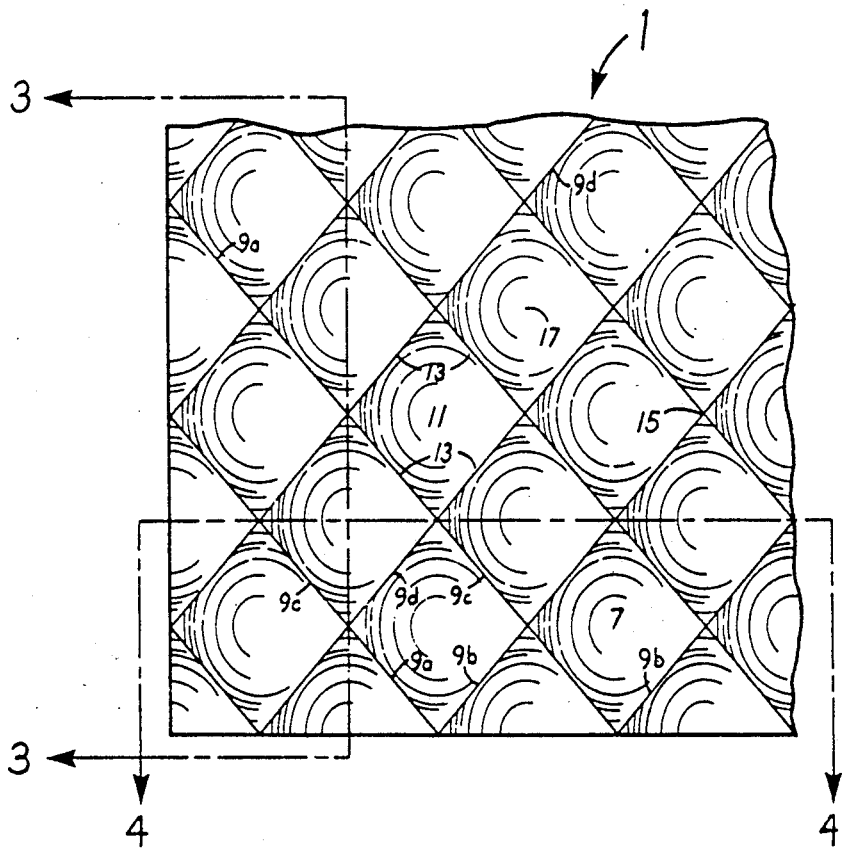
FIG. 2 is an enlarged fragmental bottom plan view of the lenticular lighting panel of FIG. 1.
Figure 3:
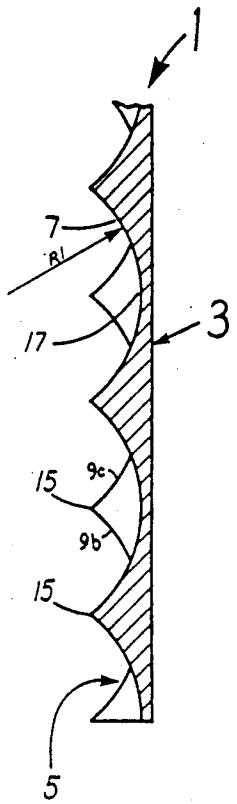
FIG. 3 is a longitudinal cross-sectional view of the panel of FIG. 2 taken along line 3—3 of FIG. 2.
Figure 4:
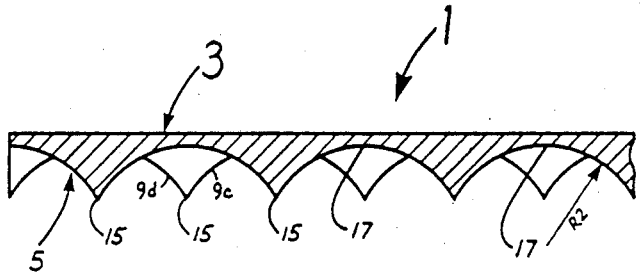
FIG. 4 is a transverse cross-sectional view of the panel of FIG. 2 taken along lines 4—4 of FIG. 2.

Referring now to the FIG. 1, reference numeral 1 indicates a lighting panel of the present invention. The panel 1 is made of a substantially transparent acrylic thermoplastic material such as acrylic (polymethlmethacrylate), polystyrene, or polycarbonate. The panel 1 includes a substantially planar upper face 3 and a lenticular lower face 5. The lenticular lower face is composed of a plurality of recessed intersecting ellipsoidal domes 7. The arcs formed by the cross-section of the domes as seen in FIGS. 3 and 4 are circular, having radii R1 of 0.199" and R2 of 0.154", respectively. The intersections of the domes form lattice lines 9*a*, 9*b*, 9*c*, and 9*d* which define an elongate diamond-shaped cell 11 having edges 13. The elongation of the diamond gives cell 11 its ellipsoidal shape and serves to reduce the amount of material, thus the weight, in each panel 1. The diamond shape of the cell gives panel 1 the same overall appearance as a pattern-12 panel.

The elongate diamond cell 11 has a length of approximately 0.320 inch and a width of approximately 0.270 inch. Lines 9*a*–*d* are all approximately 13/64 inch long as viewed in plan. The intersection of lattice lines 9*a* and 9*b*, and 9*c* and 9*d* form angles of approximately 80°. The intersections of lattice lines 9*b* and 9*c*, and 9*d* and 9*a* form angles of approximately 100°.

The intersections 15 of the lattice lines 9 lie in a common plane and are the thickest points in the panel. The centers 17 of the domes 7 similarly lie in a common plane and form the narrowest point, 0.070±0.005 inch from the plane defined by the intersection. This allows for a total thickness of the panel 1 of 0.084 inch from the plane formed by the intersection 15 to the upper face 3 of the panel.

In contrast, when hogged out conical prisms are used, the depth of the prism from the intersection of the lattice points to the center of the cell is between 0.080 to 0.086 inch, which resulted in an overall thickness of the panel of 0.090 to 0.095 inch. The weight savings occurs at all thicknesses of the panel, as compared with both the under-0.100" pattern-12 panel and the over-0.100" pattern-12 panel. The greater weight of the pattern-12 panels is shown in Table I.

TABLE I

| Thickness | Weight Of Hogged Out Panel (lbs/sq ft) | Weight of Improved Panel (lbs/sq ft) | Percent Difference |
|---|---|---|---|
| 0.090 | 0.250 | 0.198 | 26.2 |
| 0.095 | 0.281 | 0.232 | 21.1 |
| 0.110 | 0.331 | 0.292 | 13.3 |
| 0.125 | 0.425 | 0.385 | 10.3 |
| 0.165 | 0.712 | 0.675 | 5.4 |
| 1.187 | 0.787 | 0.750 | 4.9 |

Figure 5:
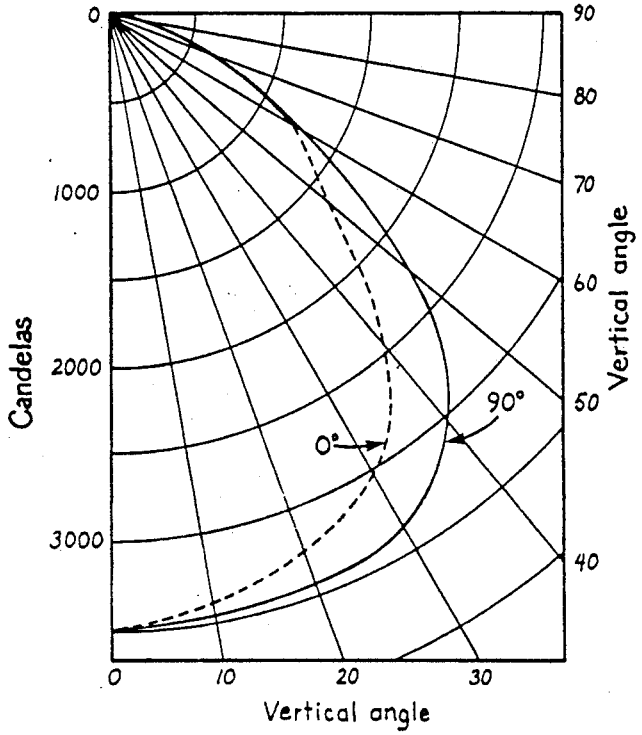
FIG. 5 is a graph showing light distribution along (0°) and across (90°) the panel of FIG. 1 as a function of vertical angles.

The use of the aspherical lenticular pattern of panel 1 provides substantially the same light control as do pattern-12 prismatic panels. The efficiency (% Lamp) of the panel 1 is the same, within the 2% error, in all zones as that of a pattern-12 prismatic panel. Thus, equivalent lighting is provided with a panel having substantially less weight. The panel 1 also controls light distribution substantially as well as the pattern-12 panel Nearly 87% (86.7%) of the light passing through panel 1 is in the zone of 0°–60°, as compared with 88.5% in the pattern-12 panel. The light distribution of panel 1 is shown in FIG. 5. A comparison of panel 1 with a pattern-12 panel is shown in Table II. The comparison was made by using a commercially available 2×4 4/40 troffer with four F40T12RS/WW Lamps having a total lumen output of 12,800 lumens.

TABLE II

| | Pattern-12 Panel | | | Lenticular Panel | | |
|---|---|---|---|---|---|---|
| Zone | Lumens | % Lamp (±2%) | % Fixture (±2%) | Lumens | % Lamp (±2%) | % Fixture (±2%) |
| 0-30 | 2973 | 23.2 | 33.2 | 2825. | 22.1 | 31.0 |
| 0-40 | 4965 | 38.8 | 55.5 | 4737. | 37.0 | 51.9 |
| 0-60 | 7914 | 61.8 | 88.5 | 7913. | 61.8 | 86.8 |
| 0-90 | 8943 | 69.9 | 100.0 | 9121. | 71.3 | 100.0 |
| 90-180 | 0 | 0.0 | 0.0 | 0. | .0 | .0 |
| 0-180 | 8943 | 69.9 | 100.0 | 9121. | 71.3 | 100.0 |

The panels 1 are manufactured from an extruded sheet of transparent thermoplastic material, as above noted, by conventional extrusion methods. The extruded thermoplastic material is embossed by a roll having a mold of the inverse of the elongate diamond lenticular pattern on its outer surface to form the pattern on the panel. Because the elongate diamond cells 11 are formed on the roll rather than being formed after molding by stretching the molded panel, the panel lacks the stresses and "wavy" lattice lines which tend to form when the panel is mechanically stretched.

The roll, with the inverse lenticular pattern, may be used to make panels of all thickness from 0.085" to 0.187". Previously, when panel thickness was altered, the entire process had to be shut down to change molds. This could take from two to three hours With the roll of the present invention, the roll is moved further from, or closer to, the smooth roll which carries the extruded thermoplastic. This takes only about one-half hour, and does not require as much extra time, as previously required after restarting the process, to stabilize the temperature of the roll, as the process was never stopped.

Numerous variations, within the scope of the appended claims, will be apparent to those skilled in the art in light of the foregoing description and accompanying drawings.

I claim:

1. A lighting panel for use in a lighting fixture, said panel being made from a light-transmitting material and having a substantially planar upper face and a lower face, said lower face including a plurality of female lenticular cells arranged in an overlapping offset pattern to form diamond-shaped cells, the intersections of said lenticular cells defining intersecting lattice lines, the intersections of said lattice lines forming the thickest points of said panel and the centers of said cells forming the thinnest points of said panel.

2. The lighting panel of claim 1, wherein said lattice lines have a length, as viewed in plan, of approximately 13/64±1/64 inch between said intersections.

3. The lighting panel of claim 1, wherein said diamond is an elongate diamond, the lenticular cells being ellipsoidal.

4. The lighting panel of claim 3 wherein said lattice lines have a length, as viewed in plan, of approximately 13/64±1/64 inch between said intersections, and wherein said diamond has a width of 0.264 to 0.270 inch and a length of 0.313 to 0.320 inch.

5. The lighting panel of claim 3, wherein the elongation extends lengthwise of the panel.

6. The lighting panel of claim 3, wherein said elongate diamond is formed from a mold having the inverse of the panel pattern thereon.

7. The lighting panel of claim 6, wherein the elongation is greater than 10%.

8. The lighting panel of claim 1, wherein the vertical distance from the intersections of said lattice lines to the centers of said cells is 0.075±0.005 inch.

9. The lighting panel of claim 8, wherein said panel has an overall thickness of less than 0.090 inch.

10. The lighting panel of claim 9, wherein said panel has a weight of less than 0.250 pounds per square foot.

11. The lighting panel of claim 1, wherein the same mold may be used to form panels of thicknesses from 0.085" to 0.187".

12. A lighting panel for use in a lighting fixture, said panel being made from a light-transmitting material and having a substantially planar upper face and a lower face, said lower face including a plurality of ellipsoidal female lenticular cells arranged in an overlapping offset pattern to form elongate diamond-shaped cells, the intersections of said lenticular cells defining intersecting lattice lines, the intersections of said lattice lines forming the thickest points of said panel and the centers of said cells forming the thinnest points of said panel, said said lattice lines having a length, as viewed in plan, of 13/64±1/64 inch between said intersections, said diamond having a width of 0.26 to 0.27 inch and a length of 0.28 to 0.32 inch, and said ellipsoidal cell having a radius of curvature in lengthwise cross-section of 0.203±0.020 inches, and a radius of curvature in crosswise cross-section of 0.156±0.020 inches.

13. A lighting panel for use in a lighting fixture, said panel being made from a light-transmitting material and having a substantially planar upper face and a lower face, said lower face being substantially covered by a plurality of female lenticular cells formed as ellipsoidal domes, said cells being arranged in an overlapping offset pattern to form elongate diamond-shaped cells, the intersections of said lenticular cells defining intersecting lattice lines, the intersections of said lattice lines forming the thickest points of said panel and the centers of said cells forming the thinnest points of said panel, the lattice lines having a length, as viewed in plan, of approximately 13/64±1/64 inch between said intersections, the vertical distance from the intersections of said lattice lines to the centers of said domes being about 0.075±0.005 inch.

* * * * *

UNITED STATES PATENT AND TRADEMARK OFFICE

CERTIFICATE OF CORRECTION

PATENT NO. : 5,003,448

DATED : March 26, 1991

INVENTOR(S) : Leo J. Horvath

It is certified that error appears in the above—identified patent and that said Letters Patent is hereby corrected as shown below:

On the title page item [75] should read --Leo J. Horvath--.

Col. 1 line 7, is "in to" should be -- in particular to--;
Col. 1 line 8, is "the of" should be --the distribution of--;
Col 4 line 59, is "panel Nearly" should be --panel. Nearly--.

Signed and Sealed this

First Day of December, 1992

*Attest:*

DOUGLAS B. COMER

*Attesting Officer*

*Acting Commissioner of Patents and Trademarks*